US009701381B2

(12) United States Patent
Schlintz et al.

(10) Patent No.: US 9,701,381 B2
(45) Date of Patent: Jul. 11, 2017

(54) BREAKAWAY SKEG FOR A MARINE PROPULSION UNIT

(71) Applicant: Caterpillar Inc., Peoria, IL (US)

(72) Inventors: John Schlintz, Milwaukee, WI (US); Bryan L. Danner, Oshkosh, WI (US); Douglas G. Bickelhaupt, Oshkosh, WI (US)

(73) Assignee: Caterpillar Inc., Peoria, IL (US)

( * ) Notice: Subject to any disclaimer, the term of this patent is extended or adjusted under 35 U.S.C. 154(b) by 760 days.

(21) Appl. No.: 14/101,385

(22) Filed: Dec. 10, 2013

(65) Prior Publication Data

US 2015/0158571 A1 Jun. 11, 2015

(51) Int. Cl.

| | |
|---|---|
| ***B63H 5/16*** | (2006.01) |
| *B63H 5/125* | (2006.01) |
| *B63H 20/00* | (2006.01) |

(52) U.S. Cl.

CPC ..... *B63H 5/165* (2013.01); *B63H 5/125* (2013.01); *B63H 20/00* (2013.01)

(58) Field of Classification Search

CPC B64H 5/165; B64H 5/125; B64H 2005/1254; B64H 20/00; B64H 20/34; B63H 5/165; B63H 5/125; B63H 2005/1254; B63H 20/00; B63H 20/34

See application file for complete search history.

(56) References Cited

U.S. PATENT DOCUMENTS

| | | | | |
|---|---|---|---|---|
| 4,493,665 | A | 1/1985 | Liddle | |
| 4,701,144 | A | 10/1987 | DeWitt, III | |
| 4,846,745 | A | 7/1989 | Lobe | |
| 5,007,868 | A | 4/1991 | Fry | |
| 5,277,632 | A | 1/1994 | Davis | |
| 5,328,397 | A * | 7/1994 | Whitty | B63B 35/7926 441/74 |
| 7,435,147 | B1 | 10/2008 | Eichinger | |
| 7,867,046 | B1 * | 1/2011 | Eichinger | B63B 43/18 440/112 |
| 2002/0121036 | A1 | 9/2002 | Dicke et al. | |
| 2010/0291816 | A1 | 11/2010 | Arvidsson | |
| 2011/0039463 | A1 | 2/2011 | Hort et al. | |

FOREIGN PATENT DOCUMENTS

| | | |
|---|---|---|
| DE | 3722259 | 1/1989 |
| EP | 1044874 | 10/2000 |

OTHER PUBLICATIONS

"FCS Fish Keel Fin", Finplug.com, Mar. 1, 2010 courtesy of Wayback Machine (https://archive.org/web/) , http://www.finplug.com/fcs-surfboard-fins/fcs-fish-keel-fin/.*

* cited by examiner

*Primary Examiner* — Craig Kim
*Assistant Examiner* — Danielle M Christensen
(74) *Attorney, Agent, or Firm* — L. Glenn Waterfield; Hibshman Claim Construction PLLC

(57) ABSTRACT

A breakaway skeg for the lower portion of a marine propulsion unit is disclosed. The skeg is designed such that the attachment features will fail under certain load or impacts, thereby preventing damage to the lower portion of the marine propulsion unit. The breakaway skeg is attached via shear tabs that include a relief that accounts for at least a part of the volume of the base portion of the shear tab. The shear tabs are designed to fail under certain circumstances before other components of the marine propulsion.

6 Claims, 6 Drawing Sheets

BREAKAWAY SKEG FOR A MARINE PROPULSION UNIT

TECHNICAL FIELD

The present disclosure relates to a breakaway skeg for the lower portion of a marine propulsion unit. The skeg is designed such that the attachment features will fail under certain load or impacts, thereby preventing damage to the lower portion of the marine propulsion unit.

BACKGROUND

Portions of a marine propulsion unit that extend into the water are susceptible to damage by underwater objects. The portions that extend below the hull of a marine vessel are especially susceptible, particularly the leading components such as the nose section and the skeg. A skeg is a fin-shaped feature that extends below the gear case of a marine propulsion unit such as an outboard motor, a stem drive, or a pod unit. The skeg extends below the radius of the propeller (or "prop") of the marine propulsion unit and serves to protect the propeller from damage from underwater impacts.

A breakaway skeg is designed to break away from the lower portion of the marine propulsion unit when the breakaway skeg impacts an underwater object. The breakaway skeg must be designed to account for impacts from the front, rear, side, and bottom. As the breakaway skeg is attached to the lower portion of the gear case, the attachment features of the breakaway skeg must minimize damage to the lower portion of the gear case when it breaks away. Damage to the lower portion of the gear case can make for a very expensive repair. In addition, excessive damage to the lower portion of the gear case can lead to loss of gear case oil and therefore extensive gear train damage.

The design of the attachment features of the breakaway skeg may account for impacts from the bottom of the marine propulsion unit. A rigidly and strongly-attached skeg would transmit impact forces upward through the marine propulsion unit and into the vessel's hull where the forces could potentially cause hull damage or even a hull breach.

The attachment features of the breakaway skeg may therefore be designed to provide a strong enough attachment to the lower portion of the gear case to stay intact during navigation but must fracture or breakaway above a predetermined stress in order to prevent damage to the lower portion of the gear case.

U.S. Pat. No. 7,435,147 to Eichinger, issued Oct. 14, 2008, entitled "Breakaway skeg for a marine propulsion device," discloses a breakaway skeg that accounts for an impact force L at locations along the total height of the skeg. The breakaway skeg disclosed by Eichinger, however, does not address impact forces from the bottom that would transmit upward through the marine propulsion unit and into the vessel's hull.

SUMMARY OF THE INVENTION

A marine propulsion unit having a breakaway skeg is disclosed. The marine propulsion unit comprises a lower gear case having a lower portion, the lower portion including a nose section, a prop section, and a shaft section having a ventral mating feature. The ventral mating feature includes a mating feature and lateral through-holes configured to accept pins. The breakaway skeg has a shear tab located along the top of said breakaway skeg and configured to mate to said mating feature, wherein said shear tab has a base portion and a tip portion, said base portion including a relief that accounts for at least part of the volume of the base portion.

In a second aspect of the current disclosure, a breakaway skeg is disclosed. The breakaway skeg comprises a shear tab located along a top of said breakaway skeg, wherein said shear tab has a base portion and a tip portion, said base portion including a relief that accounts for at least part of the volume of the base portion.

In a third aspect of the current disclosure, a marine propulsion unit having a breakaway skeg is disclosed. The marine propulsion unit comprises a lower gear case having a lower portion. The lower portion includes a nose section, a prop section, and a shaft section having a ventral mating feature. The ventral mating feature includes a first and second scallop and lateral through-holes configured to accept pins, and a breakaway skeg. The breakaway skeg comprises a first shear tab located along the top of said breakaway skeg and configured to mate to said first scallop, a second shear tab located along the top of said breakaway skeg and configured to mate to said second scallop, wherein said first and second shear tabs have a base portion and a tip portion, said base portion including a relief that accounts for at least part of the volume of the base portion.

DETAILED DESCRIPTION

Figure 1:
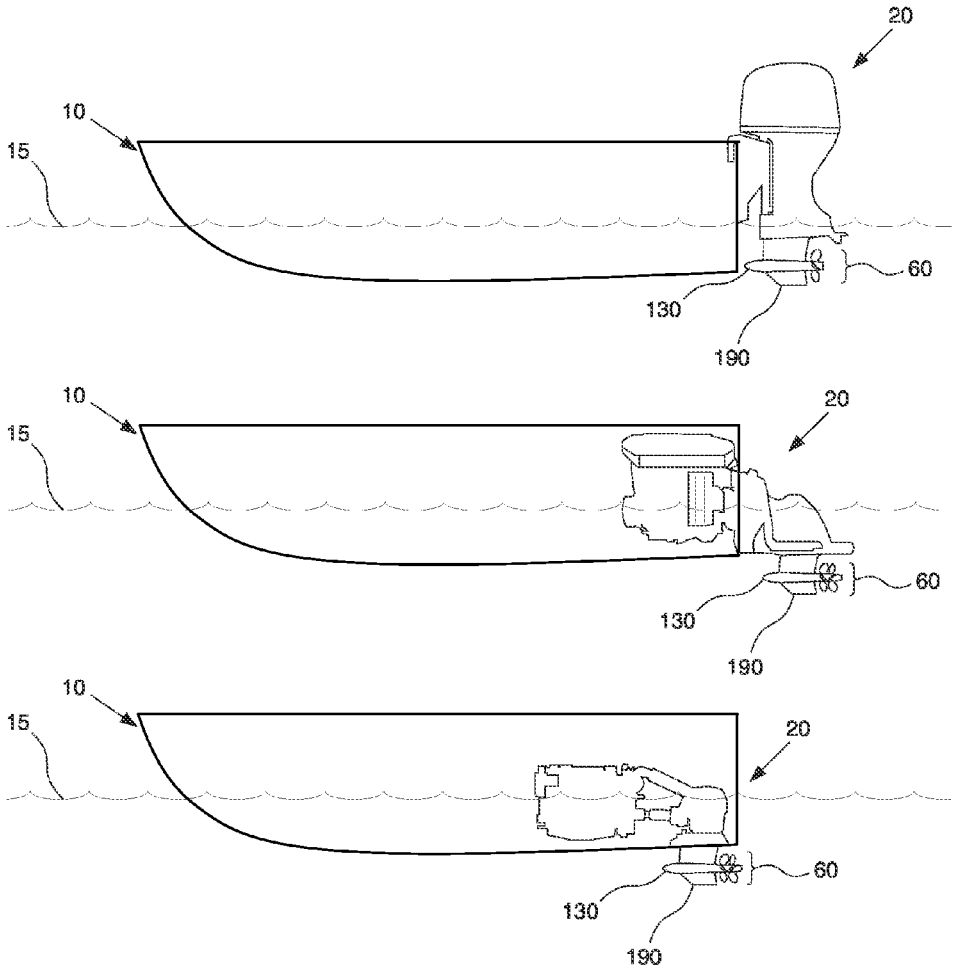
FIG. 1 is a view of three aspects of a marine propulsion unit installed on a marine vessel according to the current disclosure.

FIG. 1 shows a marine vessel 10 having a marine propulsion unit 20. The marine propulsion unit 20 includes a lower gear case 30 and a lower portion 60. The lower portion 60 includes a prop section 90, a shaft section 70, and a nose section 100. The lower portion 60 may be shaped into the form of a torpedo.

In one aspect of the current disclosure, the marine propulsion unit 20 is an outboard drive motor comprising an engine contained in an enclosure and a lower gear case 30 extending below the water and having a lower portion 60. The marine propulsion unit 20 is mounted to pivot on the transom of the marine vessel 10 to provide steering functions.

In a second aspect of the current disclosure, the marine propulsion unit 20 is a sterndrive comprising a gear box and a lower gear case 30 extending below the water and having a lower portion 60. The gearbox is connected to an engine via a driveshaft and transmits engine power at a generally 90-degree downward angle from the engine to the lower gear case 30. The marine propulsion unit 20 is mounted to pivot on the transom of the marine vessel 10 to provide steering functions.

In a third aspect of the current disclosure, the marine propulsion unit 20 is a pod unit, also known as an azimuth thruster. The pod unit comprises an upper pod unit and a lower gear case 30. The pod upper unit connects to the engine via a driveshaft and contains the transmission 50 and steering functions. The lower gear case 30 extends below the hull and is capable of rotating around 40 degrees to port or starboard in order to provide steering functions.

Figure 2:
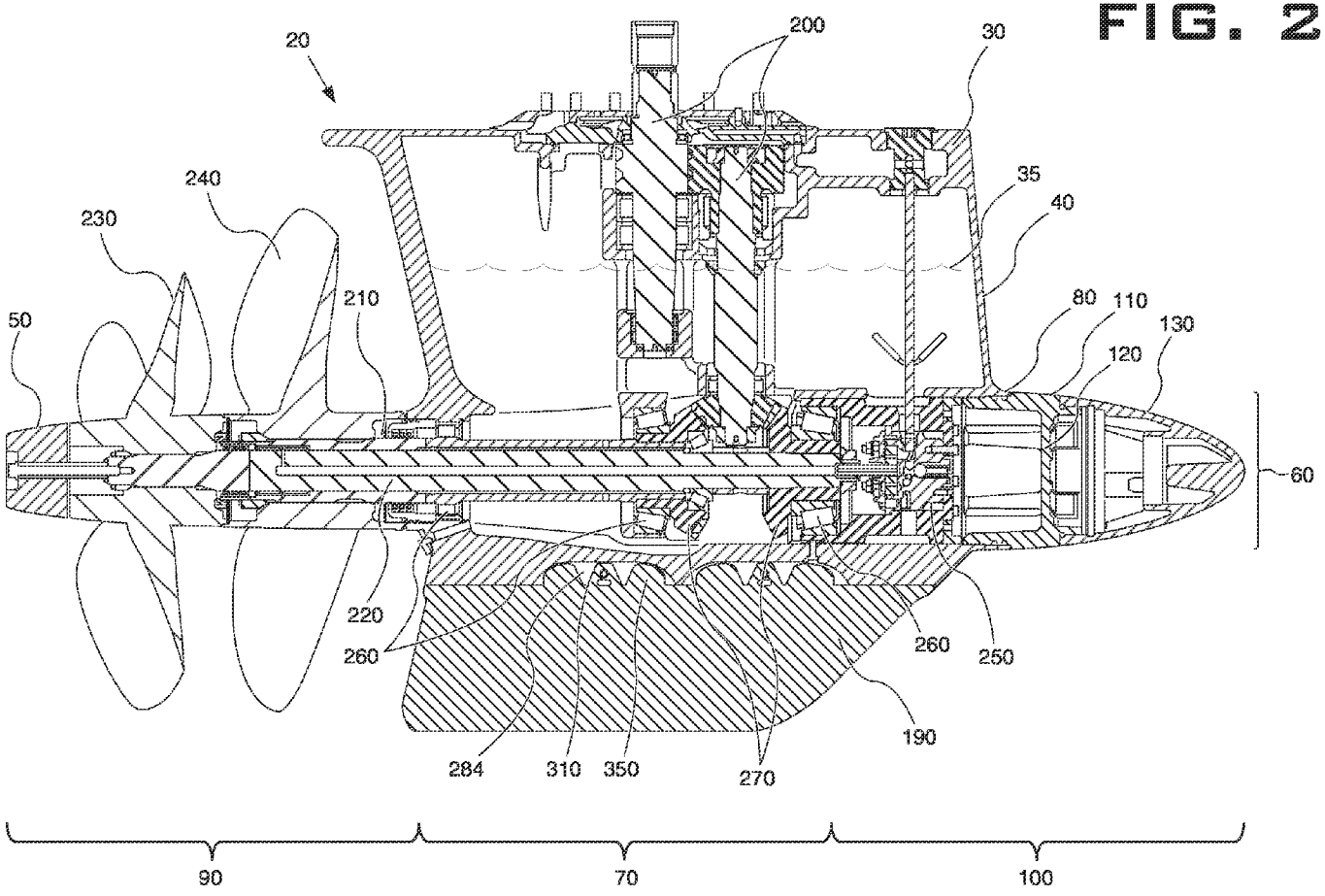
FIG. 2 is a cut-away view of a marine propulsion unit according to the current disclosure.

FIG. 2 shows the lower gear case 30 of a marine propulsion unit 20. The lower gear case 30 includes a strut 40 that extends below the waterline 15. The lower gear case 30 contains one or more driveshafts 200 for transmitting engine power to the prop(s) 225 via at least one bevel gear set 270. The lower gear case 30 also includes bearings 260 for supporting the driveshaft 200 and prop shaft 205. The lower gear case 30 is at least partially filled with oil for lubricating the driveshafts 200, prop shaft 205, bevel gear sets 270, and bearings 260. The lower gear case 30 may also include an oil pump 250.

The lower portion 60 includes a nose section 100 in the front, a shaft section 70 in the middle, and a prop section 90 at the rear. The lower portion 60 may be torpedo-shaped. The shaft section 70 includes a driveshaft 200 for driving the prop shaft 205. If the marine propulsion unit 20 includes an rear prop 230 and an front prop 240, then the shaft section 70 may contain an inner prop shaft 210 and an outer prop shaft 220. A breakaway skeg 190 is attached to the bottom of the shaft section 70. The front of the shaft section 70 includes a circular aperture 80. The inside diameter of the shaft section 70 is formed with threads near the aperture 80 and is configured to threadably accept the intermediate portion 110.

The prop section 90 is located at the rear of the lower portion 60 and includes at least one prop 225 driven by a prop shaft 205. The prop shaft 205 is driven by a bevel gear set 270 driven by a driveshaft 200. In one aspect of the current disclosure, the prop section 90 may contain a rear prop 230 driven by an inner prop shaft 210 and a front prop 240 driven by an outer prop shaft 220. The inner prop shaft 210 and outer prop shaft 220 are driven by a bevel gear set 270 driven by a driveshaft 200. The use of both a rear prop 230 and front prop 240 increases the thrust provided by the marine propulsion unit 20. The front prop 240 may have three blades while the rear prop 230 may have four blades. The rear prop 230 may need to be smaller in diameter due to flow velocity at the blade tips. In order for the smaller rear prop 230 to have equal blade area to the front prop 240, the rear prop 230 may have four blades instead of three blades. In another aspect of the current disclosure, the front prop 240 may have four blades while the rear prop 230 may have five blades. The prop section 90 may also include a propeller shaft anode 50. The propeller shaft anode may have a parabolic shape that maximizes hydrodynamic efficiency while providing anti-corrosion protection.

The nose section 100 is generally bullet-shaped and located at the front of the lower portion 60 and includes an intermediate portion 110 and a nose cone 130.

The breakaway skeg 190 attaches to a ventral mating feature 280 which is located on the underside of the shaft section 70. The ventral mating feature 280 extends generally from the front to the rear of the shaft section 70. Through holes 290 are included to accept pins 300. A mating feature such as a slot 282 or scallop 284 may be included to accept a shear tab 310 and/or an alignment tab 350 that is located on the breakaway skeg 190.

Figure 4:
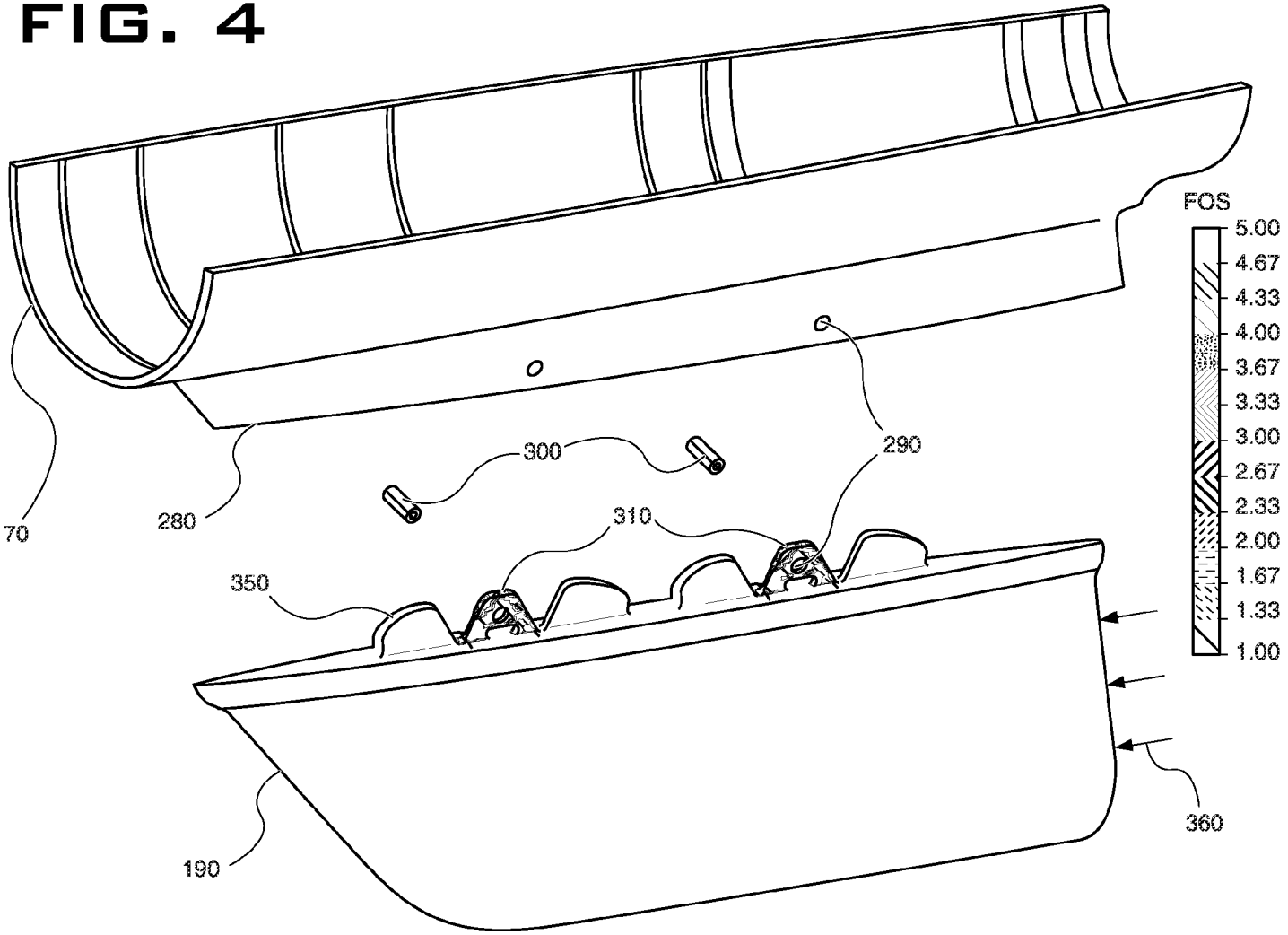
FIG. 4 is a view of the attachment features of a breakaway skeg according to the current disclosure.
Figure 5:
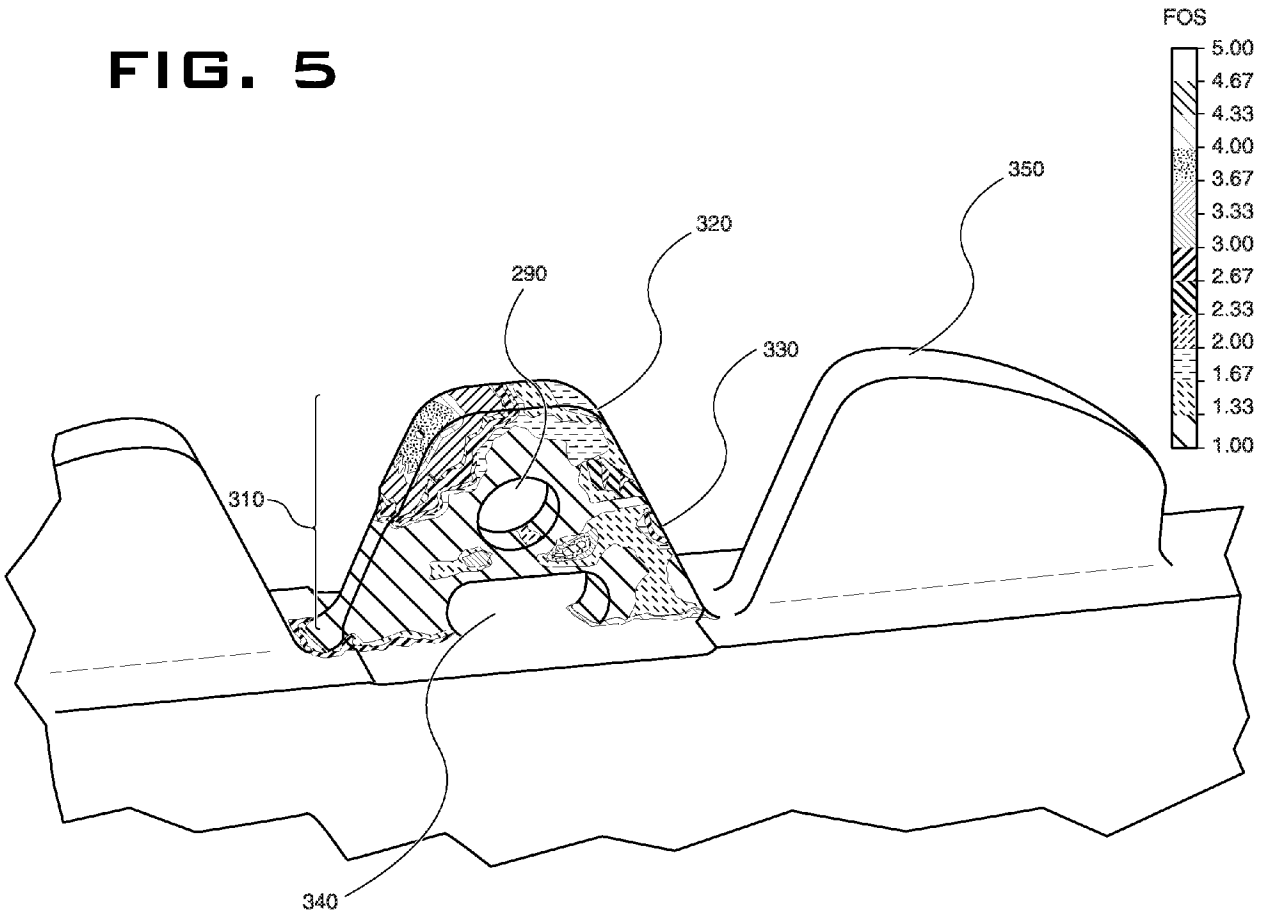
FIG. 5 is a view of the attachment features of a breakaway skeg according to the current disclosure.
Figure 6:
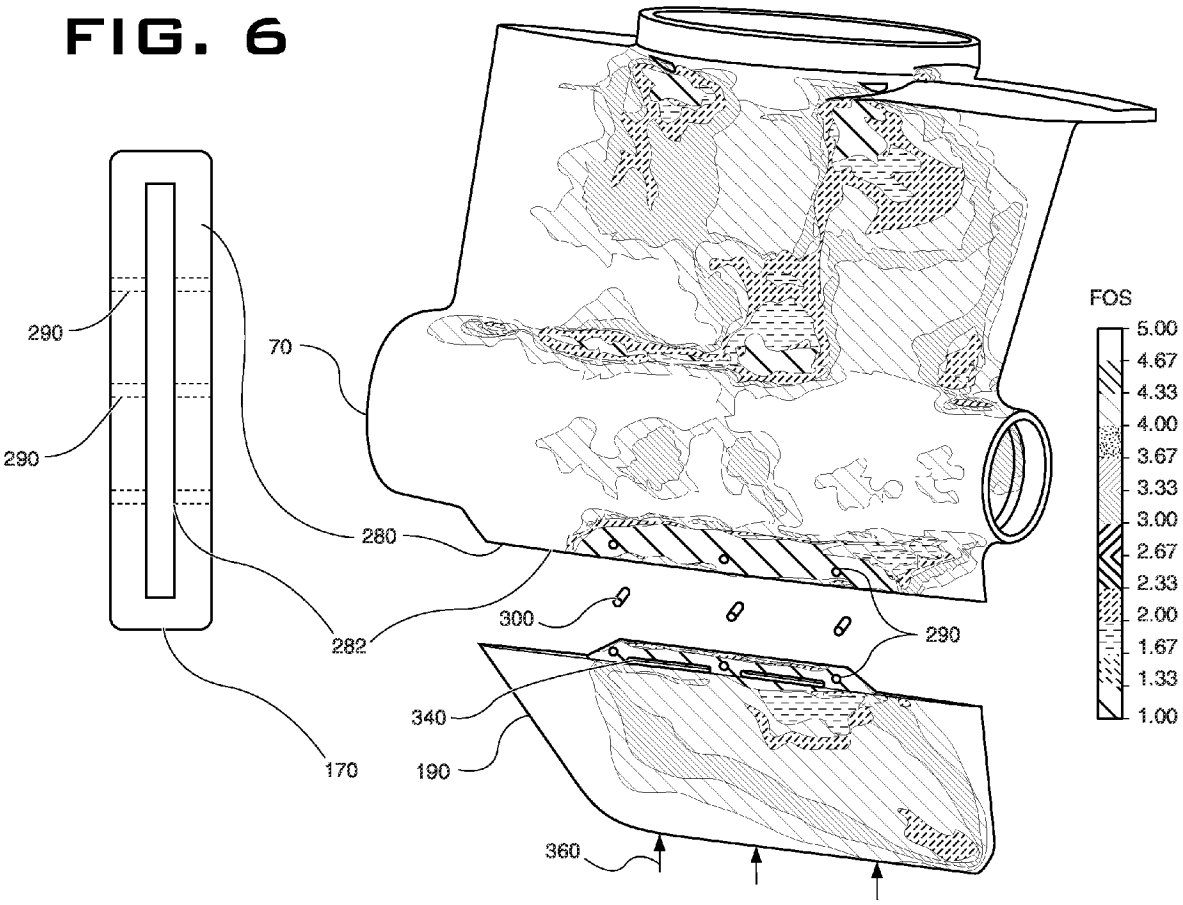
FIG. 6 is a view of the attachment features of a breakaway skeg according to the current disclosure.

The breakaway skeg 190 is generally fin-shaped and attaches to the ventral mating feature 280 on the bottom of the shaft section 70. A shear tab 310 is formed onto the breakaway skeg 190 along the top edge. The shear tab 310 includes a tip 320 and a base 330 that attaches the shear tab 310 to the top edge of the breakaway skeg 190. Multiple shear tabs 310 may be present as is shown in FIGS. 4 and 5. In one aspect of the current disclosure, the shear tab 310 may be a single continuous tab as is shown in FIG. 6. A through hole 290 in the shear tab 310 is configured to accept a pin 300 that fastens the breakaway skeg 190 to the ventral mating feature 280.

A relief 340 as shown in FIGS. 4-6 is formed into the base 330 of the shear tab 310. The relief 340 serves to tailor the stress capability of the shear tab 310 to a predetermined value or range of values. A larger relief 340 can be chosen to decrease the stress capability while a smaller relief 340 can be chosen to increase the stress capability of the shear tab 310. More than one relief 340 may be included in a single shear tab 310 to decrease the stress capability. The size and/or number of the relief 340 can be chosen to achieve a preselected failure stress for the shear tab 310.

A pin 300 is inserted through a hole 290 in the ventral mating feature 280 that aligns with a hole 290 in the shear tab 310 and fastens the breakaway skeg 190 to the ventral mating feature 280. The pin 300 is a type that is known in the art, such as a roll pin, shear pin, or dowel pin. A threaded fastener or the like could also be used.

INDUSTRIAL APPLICABILITY

Figure 3:
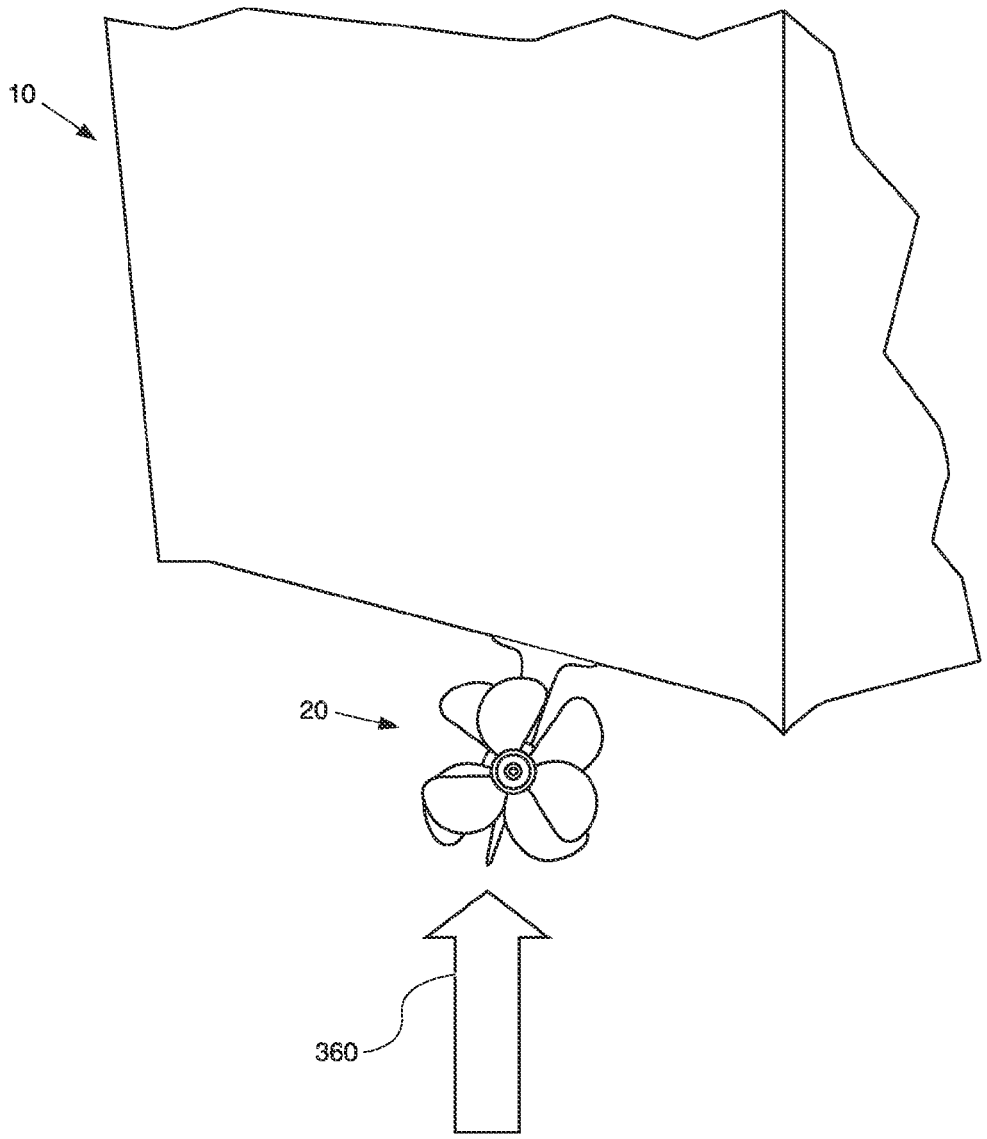
FIG. 3 is a view of marine propulsion unit installed on a marine vessel according to the current disclosure.

The breakaway skeg 190 is designed to break away from the lower portion 60 of the lower gear case 30 when it impacts an underwater object of significant mass. When the breakaway skeg 190 breaks away, the lower portion 60 should suffer as little damage as possible. The breakaway skeg 190 can be broken away in the forward direction or when backing down or when impacting an object at some angle to the keel of the marine vessel 10. The attachment features may be able to withstand normal loads such as steering and navigation while maintaining a factor of safety (FOS) of approximately 1.5-2.0 based on the yield strength of the material. An additional loading condition is a tide-out event on a high deadrise angle hull as shown in FIG. 3. This condition can cause the hull to rest on the marine propulsion unit 20. The breakaway skeg 190 according to the current disclosure is designed to break away but not allow the marine propulsion unit 20 to breach the hull of the marine vessel 10 and cause loss of hull integrity. For the high deadrise angle hull shown in FIG. 3, the angle between the upward impact force 360 and the angle of the breakaway skeg 190 may be 19 degrees, or between 15 and 25 degrees.

For instance, the breakaway skeg 190 may experience side loads up to 3400 lb during a high-speed steering maneuver of 10 degrees angle at 40 knots. Therefore, the breakaway skeg 190 must be attached to the shaft section 70 such that it can withstand this force, yet break away at a predetermined stress if it impacts and underwater object. A factor of safety (FOS) is useful in defining the stresses that the components of the lower gear case 30 must withstand. The FOS may be defined as a scalar on a continuous range from 1.0 to 5.0. In one example, a FOS scale of 1.0-5.0 may correspond to a von Mises stress of 40,000-0 psi. A FOS of 1.0 corresponds to a stress that is expected be at or beyond the design limits of the components of the lower gear case 30. FIGS. 4-6 show relative stresses in the form of shaded areas. Shaded textures correspond to the key on the side of the figures.

In one aspect of the current disclosure, an alignment tab 350 is included along the upper edge of the breakaway skeg 190. The alignment tab 350 does not include a hole 290 for accepting a pin 300. The alignment tab 350 may be interspersed with one or more shear tabs 310. There may be an alignment tab 350 in front of and behind each shear tab 310. In another aspect of the current disclosure, alignment tabs 350 and shear tabs 310 may alternate along the top of the breakaway skeg 190. Like the shear tab 310, the alignment tab 350 may be configured to mate to a mating feature such as a slot 282 or a scallop 284 in the ventral mating feature 280. The alignment tab 350 can be added to the design in order to increase the strength of the breakaway skeg 190 in response to side loads without affecting the strength in response to an upward impact force 360.

What is claimed is:

1. A marine propulsion unit, the marine propulsion unit comprising:

a lower gear case having a lower portion;

the lower portion including a nose section, a prop section, and a shaft section having a ventral mating feature;

the ventral mating feature including a first scallop and a second scallop and lateral through-holes configured to accept pins; and a breakaway skeg comprising:

a first shear tab located along a top of said breakaway skeg and configured to mate to said first scallop;

a second shear tab located along the top of said breakaway skeg and configured to mate to said second scallop;

wherein said first and second shear tabs have a base portion and a tip portion, said base portion including a relief that accounts for at least part of a volume of the base portion;

a first pair of alignment tabs flanking said first shear tab located along the top of said breakaway skeg and configured to mate to said first scallop; and a second pair of alignment tabs flanking said second shear tab located along the top of said breakaway skeg and configured to mate to said second scallop.

2. The marine propulsion unit of claim 1, wherein the first shear tab has a yield stress that is lower than a yield stress of any other component of the lower portion.

3. The marine propulsion unit of claim 1, wherein the first shear tab has a FOS between 1.0 and 5.0.

4. The marine propulsion unit of claim 1, wherein the first shear tab has a FOS of 1.0.

5. The marine propulsion unit of claim 1, wherein the base portion is designed to fail at a preselected stress in response to a force against the breakaway skeg.

6. The marine propulsion unit of claim 5, wherein the force is an upward force.

* * * * *